US006160471A

United States Patent [19]

Rybka et al.

[11] Patent Number: 6,160,471

[45] **Date of Patent: *Dec. 12, 2000**

[54] FUSIBLE LINK WITH NON-MECHANICALLY LINKED TAB DESCRIPTION

[75] Inventors: Matthew M. Rybka, Chicago; Cesar Herbias, Calumet City, both of Ill.

[73] Assignee: Littlelfuse, Inc., Des Plaines, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/237,003

[22] Filed: Jan. 25, 1999

Related U.S. Application Data

[63] Continuation-in-part of application No. 08/870,979, Jun. 6, 1997.

[51] Int. Cl.[7] ..... H01H 85/38; H01H 85/055

[52] U.S. Cl. ..... 337/278; 337/273; 337/276

[58] Field of Search ..... 337/273–282, 337/163, 166, 234, 236, 238, 239, 260, 270

[56] References Cited

U.S. PATENT DOCUMENTS

| | | | |
|---|---|---|---|
| 480,802 | 8/1892 | Blathy | 337/278 |
| 1,120,226 | 12/1914 | Murray, Jr. | 337/278 |
| 2,662,952 | 12/1953 | Nivoix | 337/222 |
| 3,601,737 | 8/1971 | Baird | 337/159 |
| 3,766,509 | 10/1973 | Cameron . | |
| 4,032,879 | 6/1977 | Monagan . | |
| 4,656,453 | 4/1987 | Reeder | 337/236 |
| 4,894,633 | 1/1990 | Holtfreter | 337/278 |
| 5,101,187 | 3/1992 | Yuza | 337/278 |
| 5,162,773 | 11/1992 | Shozaki | 337/201 |
| 5,345,210 | 9/1994 | Swensen et al. . | |
| 5,359,174 | 10/1994 | Smith et al. | 200/144 |
| 5,406,245 | 4/1995 | Smith et al. | 337/273 |
| 5,596,306 | 1/1997 | Kowalik et al. | 337/282 |

OTHER PUBLICATIONS

Specification pp. 2, 3, 4, and Figure 1 of U.S. Patent Application No. 08/870,979, filed Jun. 6, 1997, now abandoned.

*Primary Examiner*—Leo P. Picard
*Assistant Examiner*—Anatoly Vortman
*Attorney, Agent, or Firm*—Wallenstein & Wagner, Ltd.

[57] ABSTRACT

The invention is a fusible link-containing structure for an electrical fuse. The structure includes an metallic or other conductive element having a fusible link. The structure further includes at least one arc-quenching tab secured to the metallic element, and that tab may be secured to the metallic element at a position spaced apart from the fusible link. The tab or tabs are secured to the metallic element without rivets or other mechanical fasteners. For example, a lamination process may be used.

13 Claims, 1 Drawing Sheet

FUSIBLE LINK WITH NON-MECHANICALLY LINKED TAB DESCRIPTION

CROSS-REFERENCE TO RELATED APPLICATION

This is a continuation-in-part of application Ser. No. 08/870,979, filed Jun. 6, 1997.

TECHNICAL FIELD

The invention relates to an improved fusible link for a electrical or electronic fuse. More particularly, the invention relates to an improved electrical or electronic fuse with a non-mechanically linked arc-quenching tab.

BACKGROUND OF THE INVENTION

Electrical and electronic fuses are well-known in the art of circuit protection. Some of these fuses can be made of one or two pieces, whereas others must be made of many pieces. Larger fuses that accommodate larger voltage or current ratings tend to need and have many pieces.

FIG. 1 shows a prior art fusible link-containing structure 10 for an electrical fuse. Such prior art fusible links are used in semiconductor fuses, such as the L15S, L25S, and L50S semiconductor fuses available from Littelfuse, Inc., Des Plaines, Ill. The fusible link-containing structure 10 includes a metallic element 12 having a portion 14 of reduced cross-section. The reduced cross-section is typically, but not exclusively, formed by punching two lines of holes 16, 18 in the metallic element 12. The fusible link 20 results from and is formed by the holes 16, 18 in this portion 14 of reduced cross-section.

The prior art structure also includes at least one arc-quenching tab secured to the metallic element at a position spaced apart from the fusible link 20. As may be seen in FIG. 1, the prior art structure shown includes two such tabs 22 and 24, with each tab 22 and 24 being made of two strips of a pre-cured (i.e., hardened) insulating material. The pre-cured tabs 22 and 24 are secured to the metallic element 12 by means of mechanical fasteners. In the embodiment of FIG. 1, the mechanical fasteners are rivets 26, 28, 30, and 32, and the tabs 22 and 24 are made of a pre-cured melamine material. As may be seen in FIG. 1, the rivets 26, 28, 30, and 32 do not puncture the metallic element 12. Rather, they puncture only the pre-cured tabs 22 and 24, at a position relatively near the ends; 34, 36, 38, and 40 of those tabs.

One or more of these prior art structures 10 are typically inserted into a cylindrical fuse body. If several of these prior art structures 10 are used in a cylindrical fuse body, they extend radially around the lengthwise axis within that fuse body.

Although the prior art structures 10 of FIG. 1 are generally well-suited for their intended purposes, it was determined that those prior art structures 10 had certain limitations that needed to be addressed. First, as can be seen in FIG. 1, the size of the rivets 26, 28, 30, and 32 requires that the ends 34, 36, 38, and 40 of the tabs 22 and 24 extend a relatively large distance away from the top 42 and bottom 44 of the metallic element 12. In fact, the total width of the structure 10, including the solid melamine tabs 22 and 24, will be approximately ⅝". As a result, the fusible-link containing structure 10 with those outwardly extending tabs 22 and 24 will require a fuse housing that has a larger diameter than would otherwise be necessary.

Second, when the tabs 22 and 24 are riveted in place over the metallic element 12 to provide the friction fit shown in FIG. 1, there are inevitably gaps 46 between the pre-cured tabs 22 and 24 and the fusible link-containing structure 10. These gaps 46 lead to several problems. One problem is that the gaps 46 can provide a space through which an arc can travel. As a result of these gaps 46, the arc-quenching role of these pre-cured tabs 22 and 24 could be fully or at least partially defeated. Another problem is that the pre-cured tabs 22 and 24 fit relatively loosely on the metallic element 12. As a result, or perhaps upon further loosening of the rivets, there could be relative movement between the tabs 22 and 24 and the metallic element 12. The friction-fit tabs 22 and 24 could still shift outwardly along the axis of the metallic element 12, and towards the ends of that element 12. If the tabs 22 and 24 shifted a sufficient distance outwardly, one or both of the tabs 22 and 24 could obscure one or both lateral ends of the metallic element 12, making it impossible to solder or otherwise connect the ends of the metallic element 12 to the other circuit elements (for example, the end caps) in the fuse.

A further problem arises as a result of the inherent nature and functions of a fuse. When a fuse is placed within an electrical circuit, it is de signed to protect that circuit against short circuit conditions. Prior to the opening of the fuse link during such short circuit conditions, the metallic element 12 is typically heated to a high temperature. Some of the heat generated by the fuse element 12 heats the rivets of the fusible link-containing structure 10 of FIG. 1. These heated rivets are in close proximity to the cylindrical housing, and there is no sand or other similar insulator between the rivet and body inner wall. As a result of this proximity, under 300% current overload or other similar extreme conditions, the rivets can melt. Such melting rivets heat the adjacent fuse housing, and melt, char, or form a hole in that housing.

These characteristics of the prior art fuse link-containing structures suggest the merit of an improved structure.

SUMMARY OF THE INVENTION

The invention is an improved fusible link-containing structure for an electrical fuse. In its simplest form, the invention comprises a conductive element, preferably a metallic element, having a portion of reduced cross-section. The area of reduced cross-section provides a fusible link. At least one arc-quenching tab is secured to the metallic element at a position spaced apart from the fusible link portion. The improvement of the present invention is that the tab is secured to the metallic element without mechanical fasteners.

In another aspect of the invention, the arc-quenching tab is made from melamine.

In a further aspect of the invention, the arc-quenching tab is in direct face-to-face contact with the metallic element.

In yet another aspect of the invention, the metallic element is made of silver, copper, a silver alloy, or a copper alloy.

In a still further aspect of the invention, the improved structure for an electrical fuse comprises a conductive element, a fusible link contained in that conductive element, and an arc-quenching element surrounding and secured on both sides of the conductive element by a lamination process.

Accordingly, an object of the invention is a fusible link-containing structure that includes arc-quenching tabs, but which is devoid of mechanical connections between the tabs and the remainder of the structure. A further object of the invention is a structure whose tabs which do not extend appreciably away from the top and bottom of the metallic elements.

A still further object of the invention is a structure in which there are no gaps between the tabs and the metallic elements, thereby (1) eliminating a space through which an arc can travel; and (2) preventing the relative looseness of the tabs on the fusible element, and thereby virtually eliminating relative movement between the tabs and the fusible elements.

Another object of the invention is the elimination of rivets or other similar mechanical fasteners from the possibility of heated rivets proximate to the cylindrical housing, and the possibility of that rivet heating the adjacent fuse body, melting that body or forming a hole in that body.

DETAILED DESCRIPTION OF THE PREFERRED EMBODIMENT

Figure 6:
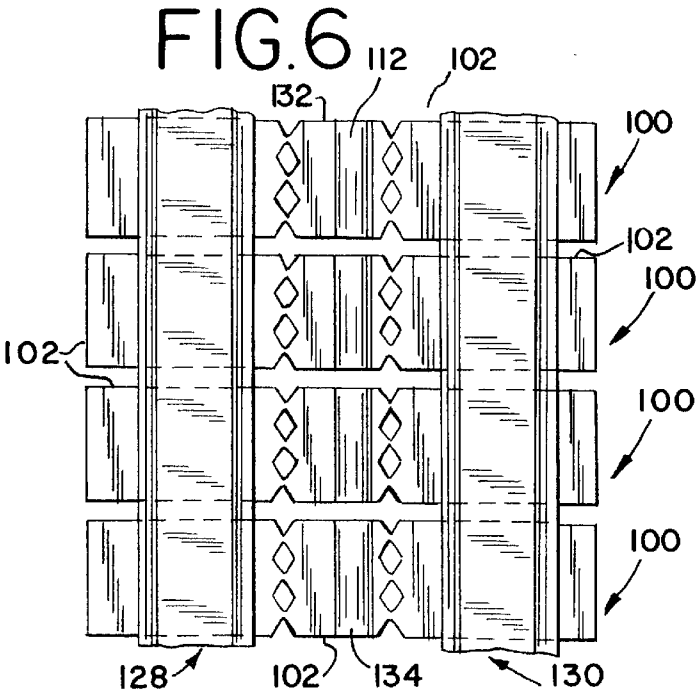
FIG. 6 is a top view of a plurality of fusible link-containing structures of FIG. 2 during one suitable process of their manufacture, and prior to their detachment from each other.

One preferred form of the present invention in its finished form is shown in FIGS. 2–5. FIG. 6 depicts four of the fusible link-containing structures in accordance with the invention during a step of one suitable process for their manufacture. As will be discussed below, the structures of FIG. 6 are subsequently detached from each other in a cutting step.

Figure 2:
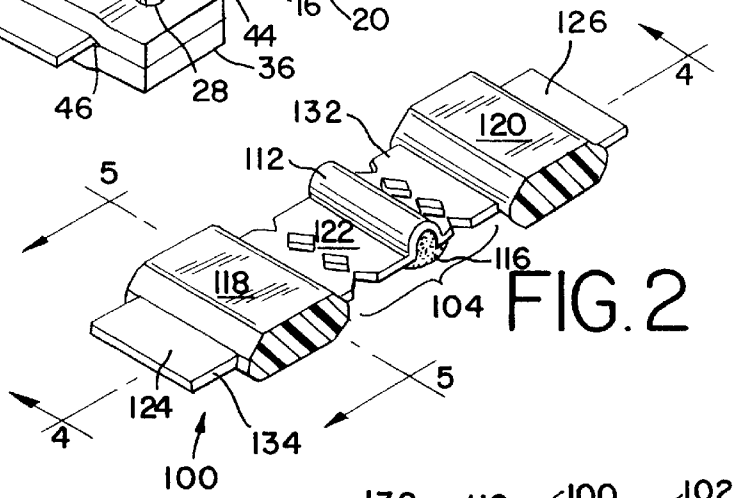
FIG. 2 is a perspective view of a fusible link-containing structure in accordance with the invention.

As may best be seen in FIG. 2, the invention is an improved fusible link-containing structure 100 for an electrical fuse (not shown). The typical length of this structure 100 can be 1 5/16". At its widest point, including the width of the melamine tabs, the width can be 3/8". One or more of these fusible link-containing structures 100 are typically inserted into a cylindrical fuse body. If several of these structures 100 are inserted into a cylindrical fuse body, they are secured to the ends of that fuse body, for example, to the metal end caps. The several structures 100 will extend radially around the lengthwise axis of that fuse body.

The fusible link-containing structure 100 is made of a number of components, as will be discussed below. These components include a metallic element 102. Generally, this metallic element 102 is made from a stamped piece of a conductive metal. While any number of conductive metals will be suitable for the present invention, it has been found that the most preferred metals are silver, copper, a silver alloy, or a copper alloy.

Figure 3:
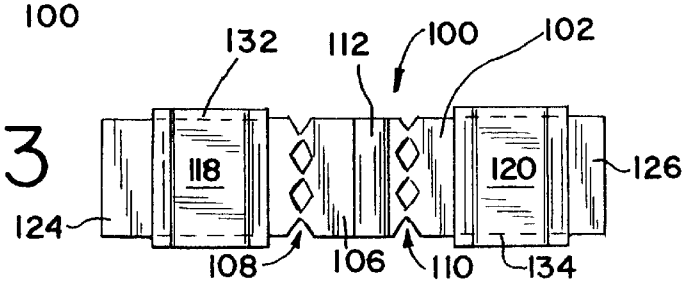
FIG. 3 is a top view of the fusible link-containing structure of FIG. 2.

The metallic element 102 has a portion of reduced cross-section 104. This portion of reduced cross-section 104 provides for the fusible link 106 of the invention. There are many possible ways of making the portion of reduced cross-section 104. One way is to skive the area, i.e., to reduce the thickness of the metal in this general area. Another way, as shown in FIGS. 2, 3, and 6, is to place orifices in the region near the mid-point of the metallic element 102. In the embodiment of FIGS. 2–6, two lines of orifices 108 and 110 are placed along either side of the longitudinal center of the metallic element 102. Although the orifices 108 and 110 of the present embodiment are of a diamond shape, it will be understood by those skilled in the art that other regular, geometric shapes, such as rectangles, squares, or circles, may also be used.

In the embodiment of FIG. 2, a semi-circular ridge 112 is placed at approximately the mid-point of the metallic element 102. As may best be seen in FIG. 4, this ridge 112 opens to the underside 114 of the metallic element 102. Filling the space created by the ridge 112 itself, and upon a portion of the underside 114 of the metallic element 102, is a mass of solidified solder 116. The solder 116 has a lower melting temperature than the pure metallic element 102.

Accordingly, under current overload conditions, this solidified solder 116 begins to melt prior to the melting of the metallic element 102. After the solder 116 has begun to melt, it forms an alloy with the metallic element 102. The resulting alloy has a lower melting temperature than the pure metallic element 102 alone. Accordingly, the fusible link 106 of the structure of FIGS. 2–6 will melt at a lower temperature than a fusible link that is not adjacent a mass of solidified solder 116.

FIG. 2 shows a pair of unitary tabs secured to the metallic element 112. As may best be seen from FIGS. 2 and 3, these tabs 118 and 120 do not include rivets or other mechanical fasteners to secure them to the metallic element 112. In addition, these tabs 118 and 120 are in a spaced apart position relative to the fusible link 106. In the embodiment shown in the FIGURES, and as may best be seen in FIG. 3, the tabs 118 are on opposite lateral sides of the fusible link 106.

Figure 4:
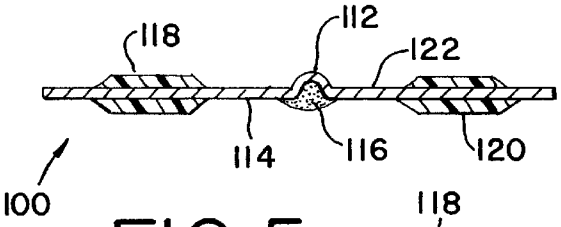
FIG. 4 is a sectional view, taken along lines 4—4 of FIG. 2, of the fusible link-containing structure of FIG. 2.
Figure 5:
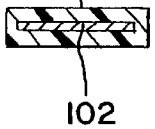
FIG. 5 is a sectional view, taken along lines 5—5 of FIG. 2, of the fusible link-containing structure of FIG. 2.

In addition, as may best be seen in FIG. 4, the tabs 118 and 120 are on the topside 122 and the underside 114 of the metallic element 102.

Figure 1:
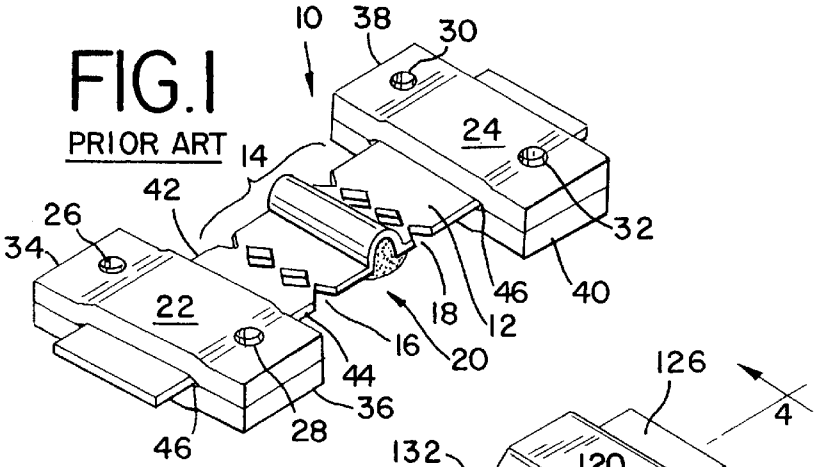
FIG. 1 PRIOR ART
FIG. 1 is a perspective view of a prior art fusible link-containing structure.

These tabs 118 and 120 can block the movement of an arc that may originate at the fusible link 106, and attempt to move outwardly towards the lateral ends 124 and 126 of the metallic element 102. There are virtually no gaps between the tabs 118 and 120 and the metallic element 102. Accordingly, unlike the prior art device of FIG. 1, an arc formed within the device of FIGS. 2–6 will not pass through any gaps, and in that way partially or fully avoid blockage by the tabs.

Tabs 118 and 120 are preferably made of a melamine material, most preferably a so-called B-stage melamine. A preferred melamine is available in white, textured semi-cured melamine impregnated glass fiber weave sheets from, for example, Spaulding Composites, of DeKalb, Ill., available as Part No. S-15750. In addition, as suggested above, the arc-quenching tabs 118 and 120 are in direct face-to-face contact with the metallic element 102, with virtually no space between the tabs 118, 120 and that element 102. As a result, no gaps exist between the tabs 118, 120 and the element 102.

In order to secure the tabs 118 and 120 without rivets or other mechanical fasteners, and in order to ensure that there are no gaps between tabs 118 and 120 and the metallic element 102, a particular laminating manufacturing process is used.

First, the B-stage melamine sheets are cut into strips of four inches or more in length, with that length depending on the number of structures 100 that are to be simultaneously manufactured. Each of these strips are also cut to a width of approximately one-quarter (0.250) inch.

The metallic elements 102, with their orifices of the desired geometric shape, ridges, and solder mass, are then fabricated by stamping in a manner that is well-known in the art. Next, one determines the portion of the metallic element 102 that is to be covered with the melamine strips.

As the melamine strips are rather thin, five or more are typically stacked upon each other. Referring now to FIG. 6, if one were to make the four structures 100 shown in that FIGURE, the four metallic elements 102 shown in the FIGURE would be placed parallel to each other. Five strips of melamine would be stacked upon each other, and the resulting rows 128 and 130 of melamine strips would be placed on the topside of the metallic element 102, parallel to each other, and to the left and right of the fusible links 106. Similar rows of melamine strips (not shown) would be placed on the underside 114 of metallic element 102, and these rows of melamine strips would be aligned with the rows 128 and 130 on the topside of the metallic element 102.

This separate "sandwich" structure is then made into a unitary, non-highly compressed structure by a lamination step, i.e., by the application of heat and pressure. Particularly, on both the topside and underside of the structure shown in FIG. 6, heat and pressure are applied using a steel platen. A silicone rubber sheet abuts the platen, to equalize pressure on the melamine sheets. A TEFLON® brand sheet is interposed between the silicone sheet and the melamine, with the TEFLON® sheet preventing sticking to the melamine during the application of heat and pressure by the platens. The "sandwich" is put under 315 degree Fahrenheit temperature and 25–500 pounds per square inch pressure for fifteen to twenty minutes. More preferably, the pressure applied is between 100–500 pounds per square inch, more preferably between 200–300 pounds per square inch, and most preferably is 250 pounds per square inch. This fully cures the melamine into a non-highly compressed structure that is one solid and unitary piece which completely surrounds the metallic element 102.

During the lamination process, the B-stage melamine is softened by the heat, and subsequently has a tendency to flow somewhat. It is desirable to prevent the flowing melamine from migrating towards the ends 124 and 126 of the metallic element 102. Such migration could result in the settling of the softened melamine on the ends 124 and 126, where it could subsequently harden and prevent good electrical contact between those ends 124 and 126 and the fuse circuit elements to which those ends 124 and 126 are to be attached. To prevent this from occurring, a KAPTON brand tape can be placed over the ends of the fusible link-containing structures 100 shown in FIG. 6.

After the lamination step has been completed, the structures 100 shown in FIG. 6 must be separated. This is done by shearing the adjacent structures 100 with a suitable shearing machine. As may be seen in FIGS. 2–3, the tabs 118 and 120 are sheared at a location very close to the top 132 and bottom 134 of metallic element 102. As a result, the tabs 118 and 120 do not extend far beyond the metallic element 102, providing a compact structure 100 as compared to the prior art of FIG. 1. The removal of the KAPTON tape from the separated structures 100 ends the manufacturing process.

As noted above, the tabs 118 and 120 are the arc-quenching elements in connection with this invention. As may best be seen in FIGS. 2, 3, and 5, these arc-quenching tabs 118 and 120 surround and are secured on both sides (top 132 and bottom 134) of the conductive metallic element 102 by the lamination process. Because of this surrounding relationship between tabs 118/120 and the conductive metallic element 102, none of the ends or sides of the metallic element 102 covered by the tabs 118 and 120 are exposed.

There are many advantages to this structure. First, the lamination step fully cures the separate, semi-cured melamine sheets into unitary, solidified melamine tabs 118 and 120. After lamination, each of these melamine tabs 118 and 120 are solid, one-piece structures that completely surround and intimately contact the metallic element 102, preventing the formation of gaps between the tabs 118 and 120 and the metallic element 102. The tabs 118 are, accordingly, very robust, with intimate and complete contact of the melamine to the metallic element 102, without any mechanical means of attachment. In addition, as described above and as shown in FIG. 6, many metallic elements 102 can be laminated at the same time.

What I claim is:

1. A fusible link structure for an electrical fuse, comprising:

a metallic element having a portion of decreased cross-sectional area defining a fusible link, the metallic element having a top surface, a bottom surface, a first side, a second side, a first end, and a second end; and, a unitary arc-quenching tab being fixedly attached to the metallic element at a position adjacent the fusible link, the tab having an inner surface in continuous contact with the top surface, bottom surface, first side and having an inner surface in continuous contact with the top surface, bottom surface, first side and second side of the metallic element to completely surround a portion of the metallic element and prevent gaps along a plane between the tab and the metallic element, the unitary tab comprising a first sheet element adjacent the top surface of the metallic element compressedly joined to a second sheet element adjacent the bottom surface of the metallic element.

2. The fusible link structure of claim 1, wherein the sheet elements are compressed with a pressure of between 100 and 500 pounds per square inch.

3. The fusible link structure of claim 1, wherein the tab further comprises a first melamine sheet element adjacent the top surface of the metallic element and a second melamine sheet element adjacent the bottom surface of the metallic element, wherein the first and second melamine sheet elements are laminated together to form a unitary structure having an inner surface in continuous contact with the metallic element.

4. The fusible link structure of claim 1, wherein the arc-quenching tab is in direct face-to-face contact with the metallic element.

5. The fusible link structure of claim 1, wherein the metallic element is made from a material selected from the group consisting of silver, copper, a silver alloy, and a copper alloy.

6. The fusible link structure of claim 1, further comprising first and second arc-quenching tabs fixedly attached to the metallic element, the first tab surrounding a portion of the metallic element adjacent the first end thereof, and the second tab surrounding a portion of the metallic element adjacent the second end thereof.

7. A fusible link structure for an electrical fuse, comprising:

a metallic element having a top surface, a bottom surface, a first side, a second side, a first end, a second end, and a fusible link portion between the first and second ends; and, first and second melamine arc-quenching sheets laminated to the metallic element at a position adjacent the fusible link to form a unitary melamine tab, a portion of the tab continuously contacting a plane of the top surface, bottom surface, first side and second side of the metallic element to completely surround a portion of the metallic element and prevent gaps between the tab and the metallic element.

8. The fusible link structure of claim 7, wherein the melamine tab is made of a B-stage melamine.

9. The fusible link structure of claim 8, wherein an additional adhesive is not introduced to the B-stage melamine.

10. The fusible link structure of claim 7, wherein a first melamine tab is fixedly laminated to the metallic element adjacent the first end thereof, and wherein a second melamine tab is fixedly laminated to the metallic element adjacent the second end thereof.

11. The fusible link structure of claim 7, wherein the melamine tab comprises a first melamine element adjacent the top surface of the metallic element and a second melamine element adjacent the bottom surface of the metallic element, the first and second melamine elements being laminated together to form the unitary melamine tab having an inner surface in continuous contact with the metallic element.

12. A fusible link structure for an electrical fuse, comprising:

a metallic element having a top surface, a bottom surface, a first side, a second side, a first end, a second end, and a fusible link portion between the first and second ends; and, a first melamine arc-quenching sheet member adjacent the top surface of the metallic element and a second melamine arc-quenching sheet member adjacent the bottom surface of the metallic element, the first and second melamine sheet members connected to each other around the metallic element without the use of mechanical fasteners.

13. The fusible link structure of claim 12, wherein the first and second melamine sheet members are laminated together to form the unitary melamine tab having an inner surface in continuous contact with the metallic element.

* * * * *